US005554195A

United States Patent [19]

Robert

[11] Patent Number: 5,554,195

[45] Date of Patent: Sep. 10, 1996

[54] PROCESS FOR THE PRODUCTION OF RESIST PRINTS

[75] Inventor: Georg Robert, Inzlingen, Germany

[73] Assignee: Sandoz Ltd., Basle, Switzerland

[21] Appl. No.: 457,637

[22] Filed: Jun. 1, 1995

[30] Foreign Application Priority Data

Jun. 3, 1994 [DE] Germany ..... 44 19 450.1

[51] Int. Cl.[6] ..... D06D 5/12

[52] U.S. Cl. ..... 8/446; 8/552; 8/615

[58] Field of Search ..... 8/446–456, 552, 8/615

[56] References Cited

U.S. PATENT DOCUMENTS

| | | | |
|---|---|---|---|
| 2,189,017 | 2/1940 | Rivat | 8/447 |
| 2,974,395 | 3/1961 | Haskel | 8/446 |
| 4,254,520 | 3/1981 | Saurman . | |

FOREIGN PATENT DOCUMENTS

| | | |
|---|---|---|
| 3235348 | 3/1984 | Germany . |
| 3834322 | 4/1990 | Germany . |
| 52-110993 | 9/1977 | Japan . |
| 4-82980 | 3/1992 | Japan . |
| 1016247 | 8/1963 | United Kingdom . |

*Primary Examiner*—Margaret Einsmann
*Attorney, Agent, or Firm*—Robert S. Honor; Carl W. Battle; Hesna J. Pfeiffer

[57] ABSTRACT

This invention relates to a process for the production of resist prints on two-dimensional textile materials, which is characterized by the steps of impregnating with a water-repellent those parts of one side of a textile piece which are to be given a resist effect, drying said textile piece and dyeing the textile piece by applying an aqueous liquor to the reverse side.

2 Claims, No Drawings

PROCESS FOR THE PRODUCTION OF RESIST PRINTS

The invention relates to a process for the production of resist prints on two-dimensional textile materials, which is characterized by the steps of impregnating with a water-repellent those parts of one side of a textile piece which are to be given a resist effect, drying said textile piece and dyeing the textile piece by applying an aqueous liquor to the reverse side.

The impregnation with the water-repellent is preferably fixed (in the usual manner, e.g. by means of a heat treatment).

Thus, both white resist prints and, if a dyestuff is added to the paste with the water-repellent, coloured resist prints may be produced (whereby the dyestuff-containing impregnation is preferably fixed).

The process according to the invention is extremely economical and environmentally friendly: the resists on the substrates are attained without the destruction of dyestuffs which is usual with the known processes, and without excessive use of dyeing assistants, especially aggressive or environmentally-harmful chemicals.

One essential aspect of the process according to the invention is the water-repellent. It prevents impregnation of the parts printed therewith by the dye liquor that is subsequently applied from the reverse side, so that subsequent dyeing of the parts printed therewith cannot take place.

The second essential aspect is the type of ground dyeing, whereby the dye liquor is only applied from the reverse side. This feature enables exact, sharp patterns (white and coloured resists) to be produced on the upper side.

Preferred water-repellents are in particular fluorocarbon polymerizates and copolymerizates, especially the commercially obtainable perfluoroalkyl/acrylic copolymers, which are present in aqueous-organic solution. However, other water-repellents are also appropriate for the process according to the invention. They may be fixed on the substrates to be treated according to the invention in such a way that they survive at least the following dyeing process without substantial bleeding. Non-ionogenic water-repellents are preferred, but in many cases (slightly) anionic or cationic compounds fulfill the desired purpose.

By applying selected extenders, such as Cerol EWL liquid (extender based on paraffin), or special cross-linking agents, such as Hydroperm MF liquid (aqueous isocyanate compound), the water-repelling effects can be improved.

The ground dyeing from the reverse side of the substrate is effected e.g. by means of a so-called 1000-point roller, a padding roller (on a rotary film printing machine), a bottom stencil (on a flat film printing apparatus) or a padding or spraying device.

In principle, all substrates which may be dyed from aqueous solution may be treated in accordance with the invention. Printing with the water-repellent and optionally with a dyestuff or dyestuff mixture are carried out in a generally known manner. The corresponding printing pastes contain a conventional thickener and optionally further printing assistants, e.g. small quantities of a wetting agent and/or fixing accelerator and/or buffer substances.

Consequently the invention also provides a process as described above, characterized in that the impregnation with the water-repellent is carried out using a printing paste, and in that this printing paste contains a dyestuff or a mixture of dyestuffs in order to attain coloured resists. The water-repellent is generally employed in amounts of 30 to 100 g/kg printing paste. After printing, the substrate is dried, then the water-repellent and optional extender and/or cross-linking agent and optional dyestuff are fixed if required, and the substrate is then optionally washed to remove the thickener and any other assistants that may be present. Depending on the type of fixing agent and the dyestuff that may be optionally employed, fixing is preferably carried out e.g. by means of a dry heat treatment or with the assistance of superheated steam or with saturated steam at 102° C. After fixing, and after drying the print if washing has taken place, the substrate is over-dyed as a whole piece, as indicated above, from the reverse side, subsequently fixed and finished in the usual manner by washing again and/or rinsing. As already stated, all fibre-containing substrates which may be dyed from aqueous solution can be treated in accordance with the invention, e.g. in the form of woven fabrics, knit fabrics, webs or carpets. Substrates consisting of fibrous mixtures may also be treated in this way.

In the following examples, the parts and percentages are by weight. The temperatures are given in degrees celsius.

EXAMPLE 1

The following resist printing preparation is printed in a pattern using a flat stencil on to a polyamide 6/Lycra 80:20 knitted fabric (weight: 190 g/m$^2$):

| | |
|---|---|
| C.I. Acid Yellow 218 (commercial form) | 10 parts by weight |
| butyl diglycol ether | 30 parts by weight |
| hot water | 350 parts by weight |
| best grade of flour thickener 10% | 500 parts by weight |
| ammonium sulphate 1:2 | 60 parts by weight |
| fluorocarbon polymerizate (trade name Sandofluor GPC) | 50 parts by weight |
| | 1000 parts by weight |

The print is dried at 110°, fixed for 30 seconds at 170° with hot air, and steamed for 20 minutes with saturated steam of 102°.

Afterwards, the resist print is sprayed from the reverse side with liquor of the following composition to a dry weight increase of 80%:

| | |
|---|---|
| C.I. Acid Blue 193 (commercial form) | 20 parts by weight |
| butyl diglycol ether | 30 parts by weight |
| hot water | 790 parts by weight |
| best grade of flour thickener 10% | 100 parts by weight |
| ammonium sulphate 1:2 | 60 parts by weight |
| | 1000 parts by weight |

The excess liquor is then removed by suction by means of a vacuum slot through the reverse side of the goods.

The goods are then dried, steamed again for 20 minutes with saturated steam of 102°, and washed first of all cold and then at 60° with an aqueous liquor containing 1 g/l of a fatty amine polyglycol ether, and the dyeing is finally dried. A yellow pattern with sharp outlines on a dark blue background is obtained.

EXAMPLE 2

The following resist-printing preparation is printed in a pattern using a rotary film printing stencil onto a polyester filament fabric with a weight of 70 g/m$^2$:

| | |
|---|---|
| sodium alginate thickener 10% | 500 parts by weight |
| water | 407 parts by weight |
| glycolic acid | 3 parts by weight |
| perfluoroalkyl/acrylic copolymer (trade name Sandofluor NFS) | 60 parts by weight |
| fat alcohol polyglycol ether | 10 parts by weight |

-continued

| | |
|---|---|
| C.I. Disperse Red 202 (commercial form) | 20 parts by weight |
| | 1000 parts by weight |

The print is dried at 110°, fixed for 1 minute with hot air of 200°, and the dried print is subsequently over-dyed from the reverse side, using a padding roller on a rotary film printing machine, with a liquor of the following composition (dry weight increase 90%):

| Over-dyeing liquor: | |
|---|---|
| C.I. Disperse Blue 79:1 (commercial form) | 30 g/l |
| alkyl polyglycol ether | 10 g/l |
| polyacrylic acid (in commercial form, "Sansapol AM") | 20 g/l |
| glycolic acid | 3 g/l |

Afterwards, the dyeing is dried, fixed for 1 minute with hot air of 200° C, subsequently rinsed cold, given reduction treatment at 60° C., rinsed cold and dried, as is conventional for polyester prints. A red pattern with sharp outlines on a dark blue background is obtained.

If, in the above-mentioned resist-printing preparation, the addition of C.I. Disperse Red 202 is dispensed with, a white resist effect on a dark blue background is obtained.

EXAMPLE 3

A mixed fabric, consisting of 37% polyester (warp) and 63% viscose (weft) with a weight of 65 g/m$^2$, is printed in a pattern, using a flat stencil, with the following resist printing paste:

| | |
|---|---|
| sodium alginate thickener 10% | 500 parts by weight |
| urea | 100 parts by weight |
| water | 282 parts by weight |
| sodium bicarbonate | 8 parts by weight |
| sodium m-nitrobenzene sulphonate | 10 parts by weight |
| fixing accelerator (Printogen HDN liquid) | 10 parts by weight |
| C.I. Reactive Blue 166 | 5 parts by weight |
| C.I. Disperse Blue 73 | 5 parts by weight |
| perfluoroalkyl/acrylic copolymer (trade name Sandofluor NFS) | 40 parts by weight |
| Cerol EWL liquid (water-repellent based on paraffin with fatty-acid-modified melamine resin) | 40 parts by weight |
| | 1000 parts by weight |

After drying the print, it is treated for 7 minutes at 175° with super-heated steam, whereupon the dyestuffs and the water-repellent mixture are fixed on the fibrous blend. Over-dyeing is subsequently carried out with a liquor of the following composition:

| Over-dyeing liquor: | |
|---|---|
| sodium bicarbonate | 8.0 g/l |
| polyacrylic acid (in commercial form) | 20.0 g/l |
| urea | 40.0 g/l |
| sodium chloride | 10.0 g/l |
| C.I. Reactive Red 147 (commercial form) | 19.6 g/l |
| C.I. Disperse Red 167 (commercial form) | 19.0 g/l |
| C.I. Disperse Violet 63 (commercial form) | 1.4 g/l |

Over-dyeing is effected on the reverse side of the substrate, using a 1000-point roller on a Rouleaux printing machine, whereby a liquor pick-up of ca. 70% results.

Subsequently, the goods are dried, and as described for printing, fixed with super-heated steam, washed and dried. During the entire treatment, the goods are conveyed in flat form. The result is a blue pattern with sharp outlines on a red background, with excellent wet and light fastness.

EXAMPLE 4

A fabric consisting of 100% mercerized cotton satin is printed in a pattern, using a flat stencil, with the following resist printing paste:

| | |
|---|---|
| C.I. Reactive Blue 207 (commercial form) | 50 parts by weight |
| urea | 100 parts by weight |
| sodium m-nitrobenzene sulphonate | 10 parts by weight |
| sodium bicarbonate | 25 parts by weight |
| water | 205 parts by weight |
| sodium alginate thickener 10% | 500 parts by weight |
| carbon fluoride polymerizate (trade name Sandofluor GPC) | 80 parts by weight |
| aqueous isocyanate compound (trade name Hydroperm MF) | 30 parts by weight |
| | 1000 parts by weight |

After drying the print at 110° C., it is fixed for 30 seconds at 170° C. with hot air, whereupon it is poured over from the reverse side with a liquor of the following composition:

| | |
|---|---|
| C.I. Reactive Black 8 (commercial form) | 70 parts by weight |
| urea | 50 parts by weight |
| water | 745 parts by weight |
| sodium alginate thickener 10% | 100 parts by weight |
| sodium m-nitrobenzene sulphonate | 10 parts by weight |
| sodium bicarbonate | 25 parts by weight |
| | 1000 parts by weight |

Subsequently excess liquor is removed by suction by means of a vacuum slot through the reverse side of the goods resulting in a liquor uptake of 80% by weight of goods. The goods are then dried, steamed again for 10 minutes with saturated steam of 102°, and rinsed first of all cold and then washed at boiling temperature as usual for reactive dye prints, rinsed cold and dried. The result is a turquoise pattern with sharp outlines on a black background.

I claim:

1. Process for the production of resist prints on two-dimensional textile pieces having an upper side and an opposed reverse side comprising the sequential steps of:

(a) impregnating those parts of the upper side of a textile piece which are to be given a resist effect with a water-repellent comprising a fluorocarbon polymerizate or copolymerizate, in admixture with an aqueous isocyanate cross-linking agent; and, optionally, a dyestuff-containing printing paste;

(b) drying said textile piece;

(c) fixing the water-repellent; and (d) dyeing the textile piece by applying an aqueous dyeing liquor to the reverse side only of said textile piece.

2. The process according to claim 1 in which the upper side of the textile piece is impregnated with a water-repellent, an aqueous isocyanate cross-linking agent, and a dyestuff containing printing paste.

* * * * *